United States Patent [19]

Spaderna

[11] 4,128,749

[45] Dec. 5, 1978

[54] LATCHING SWITCH

[76] Inventor: Conan H. Spaderna, 39 Biltmore St., Springfield, Mass. 01115

[21] Appl. No.: 721,179

[22] Filed: Sep. 7, 1976

[51] Int. Cl.[2] ..... H01H 1/50

[52] U.S. Cl. ..... 200/254; 200/16 F; 200/288

[58] Field of Search ..... 200/288, 82 R, 16 F, 200/15, 254

[56] References Cited

U.S. PATENT DOCUMENTS

| | | | |
|---|---|---|---|
| 704,694 | 7/1902 | Creveling | 200/82 R |
| 3,624,333 | 11/1971 | Schurr | 200/254 |

*Primary Examiner*—Samuel W. Engle
*Assistant Examiner*—Ralph Palo

[57] ABSTRACT

Electric switches work with an electric arc when they switch on or off. A bridge of ionized gas builds up in an air gap between the metal contacts. The larger and the more open to the outside this air gap is, the easier the arc will break up; an air draft raised by heat will lift the gas bridge from the contacts quickly, if the gap is not cased in. The present invention is a switch, offering an all-around escape for ionized, hot gases out of that air gap. At the same time, by a large lever movement a flying contact is being latched between lugs of counter contacts which form a wedge holder, thus forestalling a return of the lever. This switch is simpler to make than the conventional fulcrum metal lever, pushing with its lower end a coilspring aside and pressing contact to contact.

10 Claims, 7 Drawing Figures

LATCHING SWITCH

A latching switch after the invention has a housing of insulating material, shaped with a trough, an insulating lever, plying in the trough, being pivoted at the deep part of the trough and bearing a flying contact nearer to the handling end of the lever. The trough has at least one pair of separate contact lugs, forming a wedge-holder at one end of the lever stroke. One or two such wedge-holders are adapted to latch the lever by its flying contact without needing a coil spring, which is usually the first part to break.

The switch has a small built-in deviation of the lever run against the trough way, which deviation causes positive latching of the lever by an elastic bending bias of the lever and of the contact lugs.

The invention is shown in the drawing in general and in two applications.

Figures 1, 2, 3, 4, 5, 6, 7:
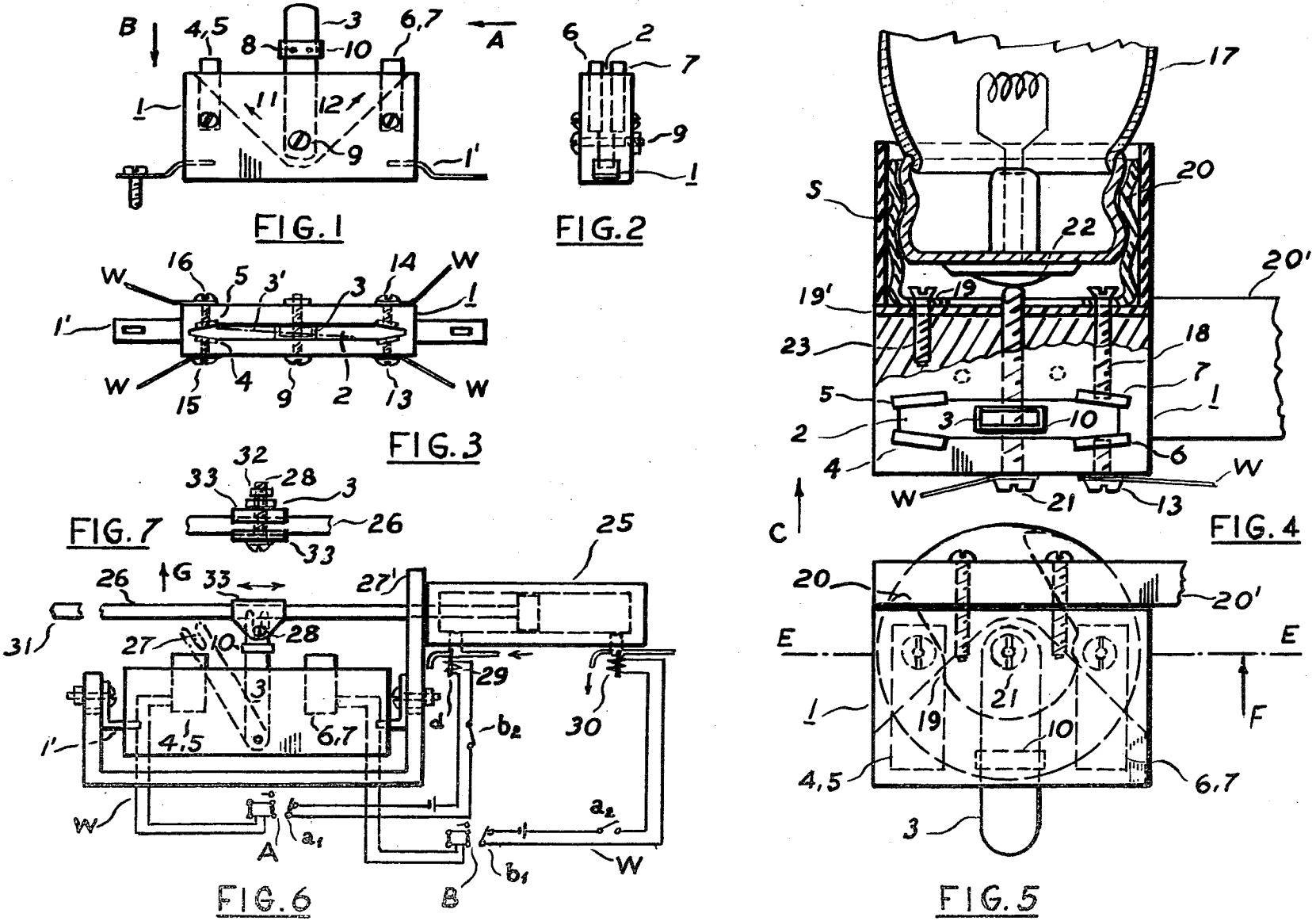
FIG. 1 is an elevated view of the latching switch after the invention.
FIG. 2 is a side view along arrow A, with the lever omitted.
FIG. 3 is a top view of the same switch, seen along the arrow B.
FIG. 4 is an elevated view of a modified latching switch on top of a lamp holder, seen along the arrow F, partially in section E—E.
FIG. 5 is a bottom view of this switch, seen along the arrow C.
FIG. 6 is an illustration of the latching switch, working as a double endswitch.
FIG. 7 is a ground view, along arrow G, of a dog, fastened to a cylinder rod that drives the switch lever.

In FIG. 1 an insulating housing 1 is molded with a trough 2 in its middle. In the trough, studded with contacts 4–7, an insulating lever 3 is plying, being pivoted by a screw pin 9, seated across the deep trough side. The lever is driven by hand or by a cylinder rod. Near its top the lever 3 bears a flying contact 10, wrapped around it and fastened to it by rivets 8. Wrapping around limits the freedom of a loose contact to shift on the lever. The contact lugs 4, 5 have a safe distance from a second lug pair 6, 7. Metal feet 1' allow tying of the switch to the ground. A slight deformation of pin 9 prevents self-unscrewing.

FIG. 2 shows the gap 2' inside each pair of contact lugs. In case of damage the lever is easily exchanged, which is impossible with most other switches. The sturdy construction of the switch makes it a good support for a lamp socket at the end of a holding arm.

A wedgelike arrangement of each pair of contact lugs, shown in FIG. 3, is designed to latch the lever 1 at the end of each of its strokes. An electric circuit is linked to the binding screws 13, 14 by wires W. After making or breaking contact, an air draft 12 clears the right hand side in the trough 2 of ionized gases. An air draft 11 does the same in the left hand side of the trough for safe opening of the circuit, linked to binding screws 15, 16, which are screwed into the contact lugs 4, 5.

An application of the latching switch is lamp switching. The lamp switch of FIGS. 4 and 5 is extended in direction of the screw pin 9 (FIG. 3). A prolongated screw pin 21 is again the pivot of a lever 3, plying in a trough 2. From a terminal head the pin also reaches up to make contact with a contact knob 22 of a light bulb 17. Between lamp socket and switch 1 a plastic spacer 19' gives an elastic bias, holding the touch of the pin with the knob. The bulb is screwed into a lamp holder socket 20, seen in section.

On its bottom the socket 20 has two lobs 19 (FIG. 5). One of these is tied to the contact lug 7 by a screw 18, seated above or below the path of the flying contact 10. The other lob is fastened to the body of the switch by a shorter screw, without drawing electrical current. Also the contact lug 4, 5 draw no current; they are latching means for the lever in "off" position. Therefore the lugs 4 and 5 may be made of a single, strong piece of brass, embedded in plastic. 20' is a holding arm, fastened to a room wall or to an upright lamp holder. S is an insulation sleeve. If the lever moves in a horizontal plane, accidental closing or opening of a circuit by gravity is unlikely. Therefore a second pair of lugs 4, 5 is then not essential.

Its easy exchangeable lever makes the latching switch a well adjustable double endswitch for steering the strokes of a compressed air cylinder by opening the air intake at one end and closing at the opposite end the cylinder valve. A dog, fastened to the cylinder rod may drive the switch lever, while riding in a lever hole (FIGS. 6, 7). Thus, strokes may be shorter and faster than possible to date. Raising the work output, speed has great value in automation. Exchangeable switch levers of different length allow fine setting of stokes. Conventional switches with springs hesitate in the dead center and need a longer dwelling time when making contact. After compression the spring has to build up its pressure toward the new contact. The present switch has no spring.

In FIGS. 6 and 7 a dog 28, fastened to a shuttling rod 26 of a compressed air cylinder 25, rides within a hole 27 of the driven switch lever 3. At start the flying contact 10 closes the contact 6, 7 whose current opens a solenoid valve 30. On the left hand end of the stroke, at the lugs 4, 5 the flying contact trips a holding relay A, that shuts its contact $a_1$ which opens a solenoid valve 29. The relay A also opens an interlocking contact $a_2$ which shuts off the solenoid current for the valve 30, whose intake is then closed. Inside the valve a conventional diaphram d is flipped by the changed air pressure and lets out air from the right hand part of the cylinder 25.

When the flying contact 10 comes to the other end of the lever stroke, the lugs 6, 7 feed a holding relay B, which closes a contact $b_1$ and opens its contact $b_2$ in the circuit of the valve 29. The lines W represent wires. Both valves 29 and 30 are of the same feeding and venting type.

In FIG. 7 a screw dog is screwed into a nut 32 and into the free ends of a clasp 33. This tightens the metal clasp around the cylinder rod 26. At the rod end is attached a tool 31, e.g. a cutting knife for a running ribbon, or a shutter for a tube, dropping small parts for an assembly operation.

If the stroke of a hydraulic cylinder is to be controlled, the lever of a latching switch may be directly coupled to a known indicator rod. Though opposite to the piston rod with respect to the piston, the indicator rod is also moved by the piston. As hydraulic cylinders are sometimes inside a compressing machine, the indicator rod may be led through a stuffing box outside the machine housing.

I claim:

1. A latching switch, comprising a housing of insulating material; a trough shaped inside the housing; a lever, insulating the operator from an electrical source, and plying in the trough with a small builtin deviation of the lever run against the trough way, and being pivoted by a pin, seated across the middle of the trough and near its bottom; a flying contact, designed to close and open a circuit and fastened to the lever between the pivot pin and the handling end of the lever; at least one pair of terminal type contact lugs, forming a wedge holder across the run of the flying contact, and latching the lever by an elastic bias.

2. A latching switch, as set forth in claim 1, further comprising a pair of lugs at an "off" position, that will forestall the lever from accidentally closing and opening a circuit.

3. A latching switch, as set forth in claim 1, wherein the flying contact is wrapped around the lever and also being riveted to it.

4. A latching switch, as set forth in claim 1, in which the pivot pin is designed as an electrical terminal, for example having electrical connection with a contact knob at the base of a socket, through which knob a lightbulb is being supplied with current.

5. A latching switch, as set forth in claim 1, with the lever being driven by a dog on a shuttling rod of a power cylinder, and having a pair of contact lugs at each end of the lever stroke, each pair of lugs steering a valve at a different end of the power cylinder, to change the direction of the stroke.

6. A latching switch, as set forth in claim 1, wherein the free ends of the terminal lugs are long enough, to fascilitate their elastic spreading apart for passage of the lever.

7. A latching switch, as set forth in claim 1, wherein the lever is plying in a horizontal plane in the trough, and is thus free from a pull by gravity which could accidentally open or close a circuit.

8. A latching switch, as set forth in claim 1, with the housing having partially embedded metal feet for attachment to the nearest ground or wall, which is accessible.

9. A latching switch, as set forth in claim 1, having the lever driven by the rod of an air power cylinder between two pairs of contact lugs, each pair steering steering a different cylinder valve by a two contact relay, which feeds a solenoid valve by one contact, and shuts off the electrical source from the other valve by the other contact, both valves being of the air - feeding and venting type.

10. A latching switch, as set forth in claim 1, having the lever driven between pairs of contact lugs by an indicator rod of a hydraulic power cylinder, each pair of lugs steering a different cylinder valve, reversing the stroke of the piston.

* * * * *